US009840875B2

(12) United States Patent
Harvey et al.

(10) Patent No.: US 9,840,875 B2
(45) **Date of Patent: *Dec. 12, 2017**

(54) SLIDE REAMER AND STABILIZER TOOL

(71) Applicant: Dynomax Drilling Tools Inc., Leduc (CA)

(72) Inventors: Michael James Harvey, Calgary (CA); Jovan Vacar, Calgary (CA); Milan Rajic, Calgary (CA)

(73) Assignee: Dynomax Drilling Tools Inc., Leduc, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/843,173

(22) Filed: Sep. 2, 2015

(65) Prior Publication Data

US 2016/0053548 A1 Feb. 25, 2016

Related U.S. Application Data

(63) Continuation of application No. 13/318,607, filed as application No. PCT/CA2010/000697 on May 5, 2010, now Pat. No. 9,157,281.

(30) Foreign Application Priority Data

May 6, 2009 (CA) ..... 2665260

(51) Int. Cl.
*E21B 10/26* (2006.01)
*E21B 10/08* (2006.01)
(Continued)

(52) U.S. Cl.
CPC ..... *E21B 10/26* (2013.01); *E21B 10/086* (2013.01); *E21B 10/28* (2013.01); *E21B 17/1078* (2013.01)

(58) Field of Classification Search
CPC ..... E21B 10/26; E21B 10/28; E21B 10/086; E21B 17/1078
See application file for complete search history.

(56) References Cited

U.S. PATENT DOCUMENTS 1,176,965 A 3/1916 Hughes
1,204,157 A 11/1916 Hughes
(Continued)

FOREIGN PATENT DOCUMENTS

CA 1 212 098 A 9/1986
EP 0 333 450 A1 9/1989
(Continued)

OTHER PUBLICATIONS

Halliburton Co., "Near Bit Reamer (NBR®) Tool," Product Information Sheet, #H03018, Sep. 2009, 2 pages.
(Continued)

*Primary Examiner* — David Andrews
*Assistant Examiner* — Kristyn Hall
(74) *Attorney, Agent, or Firm* — Seed IP Law Group LLP

(57) ABSTRACT

A downhole tool, for selectively reaming a wellbore or stabilizing drill string components within a wellbore, includes an elongate tool body adapted to receive reamer cartridges or stabilizer cartridges depending on the function desired. The reamer cartridges are radially insertable into corresponding pockets in the tool body, with each reamer cartridge having a reamer insert with an array of cutting elements. The reamer insert is disposed within a bushing and is rotatable relative thereto, about a rotational axis transverse to the longitudinal axis of the tool. However, the rotational axis is offset from the tool body axis, resulting in eccentric contact of the cutting elements with the wall of the wellbore, which in turn imparts rotation to the reamer insert when the tool is being moved axially through a wellbore without
(Continued)

rotation. When the tool is to be used for stabilization, the reamer cartridges can be removed and replaced with stabilizer cartridges having stabilizer inserts with hard-faced stabilizer cones.

19 Claims, 4 Drawing Sheets

(51) Int. Cl.
*E21B 10/28* (2006.01)
*E21B 17/10* (2006.01)

(56) References Cited

U.S. PATENT DOCUMENTS

| | | | | |
|---|---|---|---|---|
| 1,399,831 | A | | 12/1921 | Wadsworth |
| 1,747,908 | A | | 2/1930 | Seifert |
| 1,899,727 | A | | 2/1933 | Sandstone |
| 2,637,529 | A | | 5/1953 | Howell |
| 3,173,500 | A | | 3/1965 | Stuart et al. |
| 3,398,804 | A | | 8/1968 | Holbert |
| 4,385,669 | A | | 5/1983 | Knutsen |
| 4,485,879 | A | | 12/1984 | Kamp et al. |
| 4,492,276 | A | | 1/1985 | Kamp |
| 4,561,508 | A | | 12/1985 | Garrett |
| 4,577,701 | A | | 3/1986 | Dellinger et al. |
| 4,583,604 | A | | 4/1986 | Greer |
| 4,646,856 | A | | 3/1987 | Dismukes |
| 4,775,017 | A | | 10/1988 | Forrest et al. |
| 4,862,974 | A | | 9/1989 | Warren et al. |
| 4,941,951 | A | | 7/1990 | Sheppard et al. |
| 4,958,692 | A | | 9/1990 | Anderson |
| 5,184,687 | A | | 2/1993 | Abdrakhmanov et al. |
| 5,474,143 | A | | 12/1995 | Majkovic |
| 5,522,467 | A | | 6/1996 | Stevens et al. |
| 5,722,496 | A | | 3/1998 | Connell et al. |
| 5,810,100 | A | * | 9/1998 | Samford ..... E21B 17/1064 166/241.3 |
| 5,819,862 | A | | 10/1998 | Matthias et al. |
| 6,209,667 | B1 | | 4/2001 | Murray et al. |
| 6,213,229 | B1 | | 4/2001 | Majkovic |
| 6,234,261 | B1 | | 5/2001 | Evans et al. |
| 6,640,910 | B2 | | 11/2003 | Grupping |
| 7,139,689 | B2 | | 11/2006 | Huang |
| 7,299,886 | B2 | | 11/2007 | Wenzel |
| 7,562,725 | B1 | | 7/2009 | Broussard et al. |
| 8,201,642 | B2 | | 6/2012 | Radford et al. |
| 8,276,689 | B2 | | 10/2012 | Giroux et al. |
| 2006/0237234 | A1 | | 10/2006 | Dennis et al. |
| 2012/0279784 | A1 | | 11/2012 | Harvey et al. |
| 2016/0047169 | A1 | | 2/2016 | Livingstone |
| 2016/0138341 | A1 | | 5/2016 | Berube et al. |

FOREIGN PATENT DOCUMENTS

| | | | |
|---|---|---|---|
| GB | 2 349 658 | A | 11/2000 |
| GB | 2 462 306 | A | 2/2010 |
| GB | 2468781 | A | 9/2010 |
| SU | 1270282 | A1 | 11/1986 |
| WO | 2004/042184 | A1 | 5/2004 |
| WO | 2010/127450 | A1 | 11/2010 |
| WO | 2012/021069 | A1 | 2/2012 |

OTHER PUBLICATIONS

Schlumberger, "PowerDrive vorteX RT," Product Information Sheet, #09-DR-0112, 2009, 2 pages.
Extended European Search Report dated Nov. 12, 2014, for corresponding EP Application No. 10771943.7-1605, 6 pages.
International Search Report and Written Opinion dated Jul. 20, 2010, for corresponding International Application No. PCT/CA2010/000697, 2 pages.
International Search Report and Written Opinion dated May 16, 2014, for corresponding International Application No. PCT/CA2014/050192, 6 pages.
Written Opinion of the International Searching Authority for PCT/CA2010/000697—dated Jul. 20, 2010—3 pages.
Extended European Search Report, dated Oct. 11, 2016, for European Application No. 14761081.0-1610 / 2964870, 8 pages.

* cited by examiner

SLIDE REAMER AND STABILIZER TOOL

FIELD OF THE INVENTION

The present invention relates in general to reamers and stabilizers for use in the drilling of boreholes, and in particular to reamers and stabilizers used in conjunction with downhole motors.

BACKGROUND OF THE INVENTION

In drilling a borehole into the earth, such as for the recovery of hydrocarbons (e.g., crude oil and/or natural gas) from a subsurface formation, it is conventional practice to connect a drill bit onto the lower end of an assembly of drill pipe sections connected end-to-end (commonly referred to as a "drill string"), and then rotate the drill string so that the drill bit progresses downward into the earth to create the desired borehole. A typical drill string also incorporates a "bottom hole assembly" ("BHA") disposed between the bottom of the drill pipe sections and the drill bit. The BHA is typically made up of sub-components such as drill collars and special drilling tools and accessories, selected to suit the particular requirements of the well being drilled. In conventional vertical borehole drilling operations, the drill string and bit are rotated by means of either a "rotary table" or a "top drive" associated with a drilling rig erected at the ground surface over the borehole.

During the drilling process, a drilling fluid (commonly referred to as "drilling mud") is pumped downward through the drill string, out the drill bit into the borehole, and then back up to the surface through the annular space between the drill string and the borehole. The drilling fluid carries borehole cuttings up to the surface while also performing various other functions beneficial to the drilling process, including cooling the drill bit cooling and forming a protective cake on the borehole wall (to stabilize and seal the borehole wall).

As an alternative to rotation by a rotary table or a top drive, a drill bit can also be rotated using a "downhole motor" (alternatively referred to as a "drilling motor" or "mud motor") incorporated into the drill string immediately above the drill bit. The mud motor is powered by drilling mud pumped under pressure through the mud motor in accordance with well-known technologies. The technique of drilling by rotating the drill bit with a mud motor without rotating the drill string is commonly referred to as "slide" drilling, because the non-rotating drill string slides downward within the borehole as the rotating drill bit cuts deeper into the formation. Torque loads from the mud motor are reacted by opposite torsional loadings transferred to the drill string.

Downhole motors are commonly used in the oil and gas industry to drill horizontal and other non-vertical boreholes (i.e., "directional drilling"), to facilitate more efficient access to and production from more extensive regions of subsurface hydrocarbon-bearing formations than would be possible using vertical boreholes.

It is very common for a BHA to incorporate a reaming tool ("reamer") and/or a stabilizer tool ("stabilizer"). Reaming may be required to enlarge the diameter of a borehole that was drilled too small (due perhaps to excessive wear on the drill bit). Alternatively, reaming may be needed in order to maintain a desired diameter (or "gauge") of a borehole drilled into clays or other geologic formations that are susceptible to plastic flow (which will induce radially-inward pressure tending to reduce the borehole diameter).

Reaming may also be required for boreholes drilled into non-plastic formations containing fractures, faults, or bedding seams where instabilities may arise due to slips at these fractures, faults or bedding seams. A stabilizer, following closely behind the drill bit, is commonly used to keep drill string components (including the drill bit) centered in the borehole. This function is particularly important in directional drilling, in order to keep a borehole at a particular angular orientation or to change the borehole angle.

Numerous and varied types of reamers and stabilizers are known in the prior art. Representative examples of prior art reamers and stabilizers may be seen in U.S. Pat. No. 4,385,669 (Knutsen); U.S. Pat. No. 5,474,143 (Majkovic); and U.S. Pat. No. 6,213,229 (Majkovic). In prior art reamers, however, the cutting elements are effective to increase or maintain a borehole diameter only when the drill string is rotating; similarly, the centralizing elements of prior art stabilizers are effective for their purpose only when the drill string is rotating. This is because the cutting elements and centralizing elements of prior art reamers and stabilizers are typically fixed to the corresponding tool bodies, so they rotate about the longitudinal axis of the tool. As a result, the cutting and centralizing elements tend to wear evenly, which allows the reamers and stabilizers to remain effect for their respective purposes despite a certain degree of wear. However, in cases where a non-rotating, drill string is being moved axially with a wellbore (such as in slide drilling and in "tripping" operations), the cutting and centralizing elements of known reamers and stabilizers do not rotate, which causes these elements to wear unevenly as they scrape against the sidewalls of the borehole.

For these reasons, there is a need for reamers and stabilizers that are effective for their respective purposes in a drill string that is being moved axially within a wellbore but without rotation. The present invention is directed to this need.

BRIEF SUMMARY OF THE INVENTION

The present invention provides a downhole tool that can be used either for reaming a wellbore or for stabilizing drill string components within a wellbore. For purposes of wellbore reaming, the tool will be fitted with reamer cartridges that are radially insertable into corresponding pockets formed into the circumferential surface of the tool. Each reamer cartridge includes a reamer insert having an array of cutting elements, with the reamer insert being disposed within a bushing and being rotatable relative thereto, about a rotational axis transverse to the longitudinal axis of the tool. However, the rotational axis of the reamer insert is offset from the tool's longitudinal axis, such that when the tool is being moved axially through a wellbore without rotation of the drill string, the cutting elements on one side of the reamer insert will contact the wellbore wall first, thereby imparting rotation of the reamer insert as the tool moves through the wellbore. When it is desired to use the tool as a stabilizer, the reamer cartridges are removed and replaced with stabilizer cartridges having stabilizer inserts with hard-faced stabilizer cones.

Rotation of the reamer and stabilizer inserts about a transverse axis facilitates optimal tool performance by minimizing torque and drag on the reaming and stabilizing elements, thereby promoting more even wear and longer downhole service life before requiring replacement. The rotation of the inserts, whether during operations in which the downhole tool is rotating with a rotating drill string, or during operations in which a non-rotating drill string incorporating the downhole tool is being moved axially with a wellbore, reduces or eliminates drag and differential sticking against the wellbore wall (drag and differential sticking being particularly problematic when drilling non-vertical wellbores). In addition, the rotation of the reamer and stabilizer inserts has the further effect of reducing the torque required to rotate the drill string in both vertical and non-vertical wellbores, due to reduced drag and differential sticking.

In accordance with a first aspect, the present invention provides a downhole tool comprising an elongate main body having a longitudinal axis; an outer surface; and a plurality of channels formed into said outer surface, with said channels dividing the main body into a plurality of blade sections corresponding in number to the number of channels; with each of at least two of the blade sections having one or more cartridge pockets formed into the outer surface thereof, with each cartridge pocket being configured to receive a tool cartridge housing a tool insert such that the tool insert is rotatable about a rotational axis transverse to the longitudinal axis of the main body.

Embodiments of the drilling tool as described immediately above may be used effectively in a rotating drill string for either reaming or stabilizing purposes (depending on the type of tool insert used) when the tool is set up with only one tool insert is each blade section.

In another embodiment, the present invention provides a downhole tool comprising an elongate main body having a longitudinal axis; an outer surface; three channels formed into said outer surface, with said channels dividing the central portion of the main body into three blade sections; and with one or more cartridge pockets being formed into each blade section. In this embodiment, at least one cartridge pocket in each blade section has a tool cartridge removably retained therein, with the tool cartridge comprising: a cartridge bushing having a cylindrical bore with a centroidal axis transverse to, and offset from, the longitudinal axis of the main body; and a tool insert rotatable within the cartridge bushing about a rotational axis coincident with said centroidal axis of the cartridge bushing.

In both of the embodiments of the downhole tool described above, the tool insert may be adapted for reaming a wellbore, stabilizing drill string components within a wellbore, or for other wellbore conditioning purposes. In preferred embodiments, the channels in the main body will be angularly skewed relative to the longitudinal axis. In alternative embodiments, however, the channels could have a different orientation (for example, parallel to the longitudinal axis of the main body).

In accordance with a second aspect, the present invention provides a tool cartridge having a rotatable tool insert, for use in conjunction with the aforesaid downhole tool. The tool insert may be a reamer insert or a stabilizer insert, or may be designed to carry out other types of wellbore conditioning or accessory functions, in various different field applications and in different positions in the drill string.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
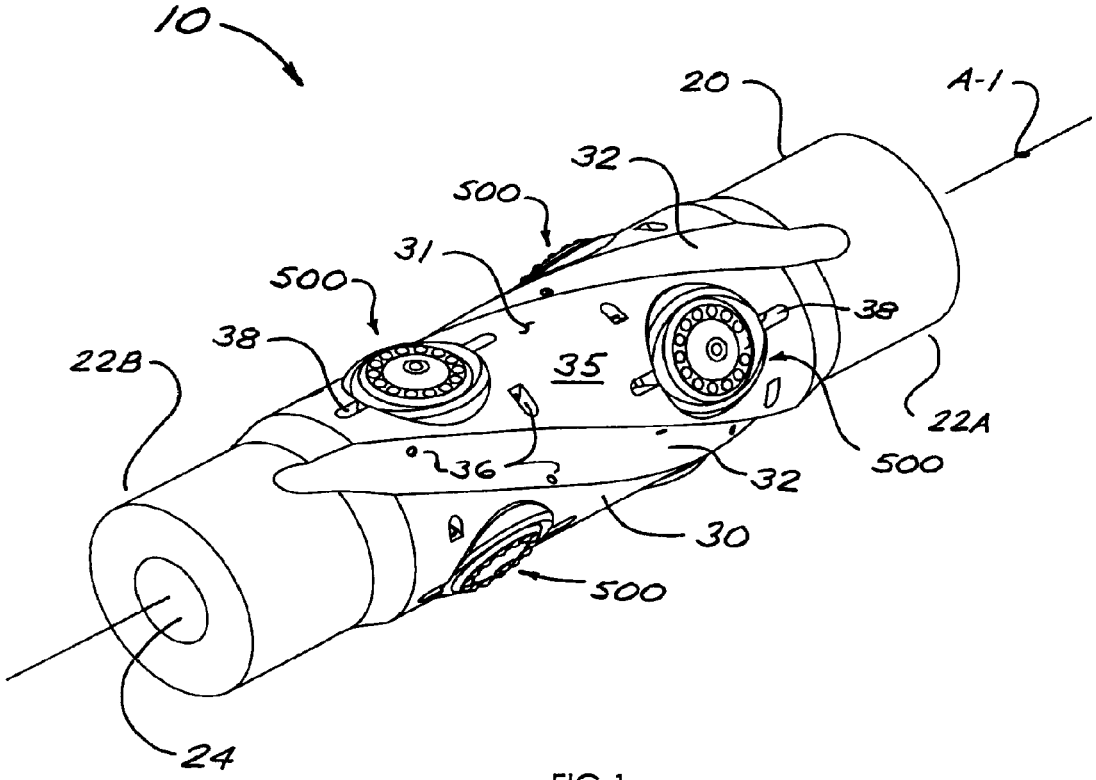
FIG. 1 is an isometric view of a reamer/stabilizer tool in accordance with a first embodiment of the present invention, shown fitted with reamer cartridges.

FIG. 1 illustrates a reaming and stabilizing tool ("reamer/stabilizer") 10 in accordance with one embodiment of the present invention. Reamer/stabilizer 10 includes an elongate tool body 20 having a longitudinal axis A-1, an upper end 22A, and a lower end 22B, plus a central bore 24 for circulation of drilling fluid through tool body 20. In the illustrated embodiment, tool body 20 is shown as being of a generally cylindrical configuration, but this is not essential. Persons skilled in the art will readily appreciate that tool body 20 could be of other geometric configurations (such as, by way of non-limiting example, a tool body having a square or other polygonal cross-section).

Upper and lower ends 22A and 22B of tool body 20 are adapted for connection to other drill string components (e.g., taper-threaded "pin" and "box" connections, as commonly used in drilling oil and gas wells). In the illustrated embodiment, tool body 20 has an enlarged central section 30 with an outer surface 31. In the illustrated embodiment, central section 30 is of generally cylindrical configuration, with a diameter greater than the outer diameter of tool body 20 at its upper and lower ends 22A and 22B. In alternative embodiments, however, tool body may have a substantially uniform cross-section (of circular or other configuration) along its length, rather than having sections of reduced size at one or both ends.

A plurality of channels 32 are formed into the outer surface 31 of central section 30, to allow upward flow of drilling fluid and wellbore cuttings. In the illustrated embodiments, channels 32 are diagonally or helically-oriented relative to longitudinal axis A-1 of tool body 20. However, this is not essential, and in alternative embodiments channels 32 could be of a different orientation (for example, parallel to longitudinal axis A-1). Channels 32 may extend partially into regions of tool body 20 beyond central section 30, as illustrated in FIG. 1, but this is not essential. Channels 32 effectively divide central section 30 of tool body 20 into a corresponding plurality of blade sections ("blades") 35. In the embodiment shown in FIGS. 1 and 2, tool body 20 has three channels 32 and three blades 35; however, alternative embodiments may have different numbers of channels 32 and blades 35.

Figure 2:
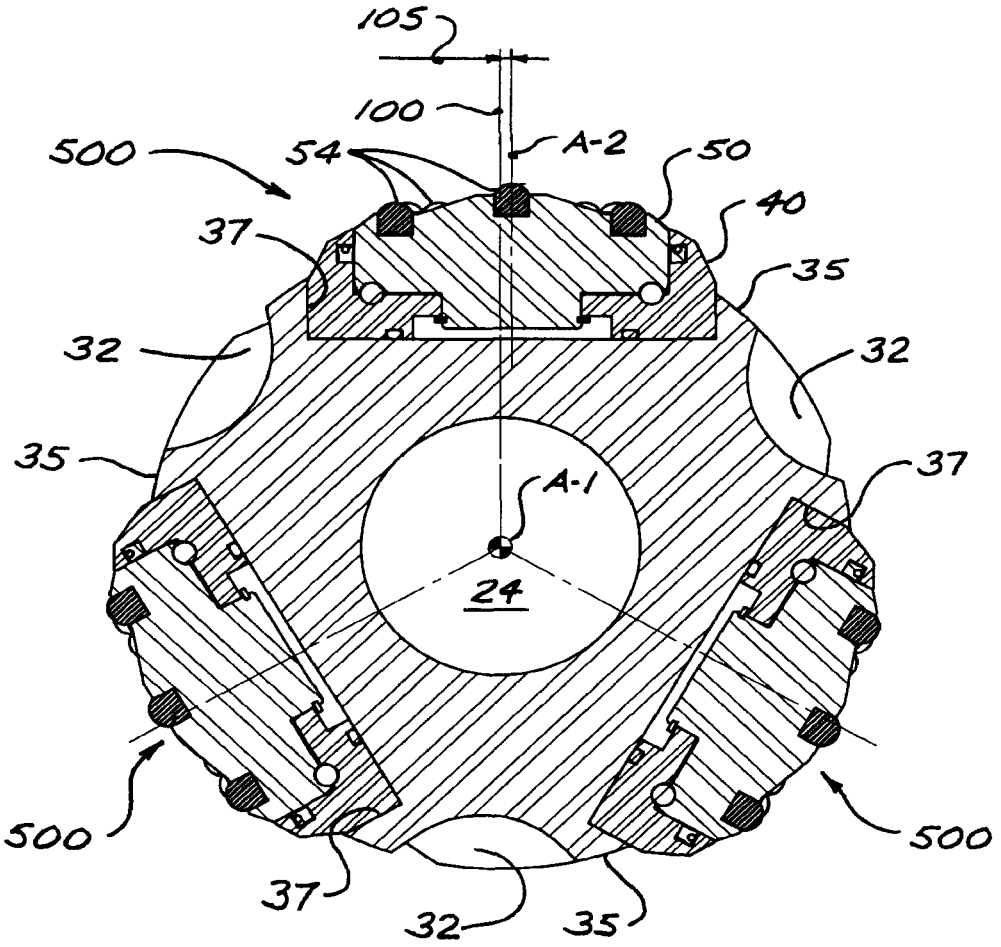
FIG. 2 is a transverse cross-section through the tool shown in FIG. 1.

Formed into outer surface 31 of each blade 35 are one or more cartridge pockets 37, as best seen in FIG. 2. Each cartridge pocket 37 is configured to receive a tool cartridge incorporating a cartridge bushing 40. In the embodiment shown in FIG. 1, each blade 35 has two cartridge pockets 37, but this is by way of non-limiting example only. In alternative embodiments, each blade could be provided with only a single cartridge pocket 37, particularly for situations in which reamer/stabilizer 10 will be used in a rotating drill string (as opposed to operations in which the drill string is not rotated).

Cartridge bushing 40 is configured to receive a tool insert in the form of a reamer insert 50 as in FIGS. 1 and 2 (or, alternatively, a stabilizer insert 60, as described later herein), such that reamer insert 50 is rotatable relative to cartridge bushing 40 about a rotational axis A-2 which is substantially perpendicularly transverse to longitudinal axis A-1 of tool body 20, but does not intersect longitudinal axis A-1. This relationship between longitudinal axis and rotational axis A-2 may be best appreciated from FIG. 2, in which it can be seen that a reference line 100 parallel to rotational axis A-2 and intersecting longitudinal axis A-1 is offset from rotational axis A-2 by an offset distance 105. The practical and beneficial effect of this offset of rotational axis A-2 will be discussed later herein.

As indicated above, rotational axis A-2 of each tool insert is transverse to longitudinal axis A-1 of tool body 20, but this is not to be understood as requiring precise perpendicularity. In some embodiments, rotational axis A-2 will be precisely perpendicular to longitudinal axis A-1, but this is not essential. In alternative embodiments, rotational axis A-2 may be tilted from perpendicular relative to longitudinal axis A-1, which configuration may be beneficial in inducing rotation of the tool inserts during operations in which the drill string is being rotated.

Figure 3:
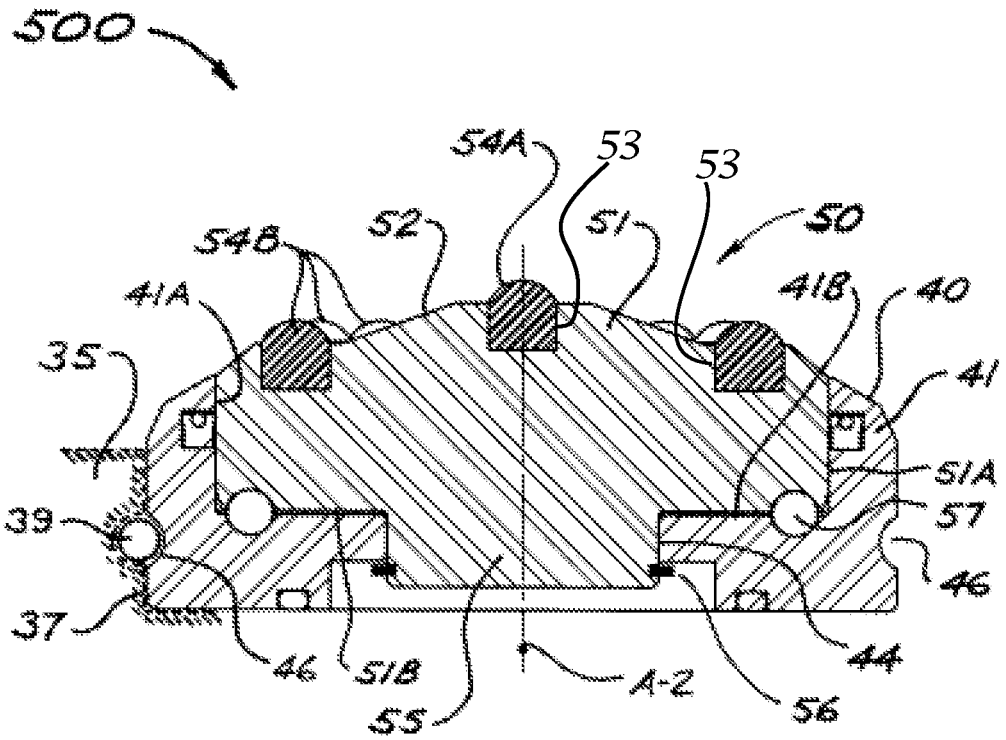
FIG. 3 is an enlarged cross-section through one embodiment of a reamer cartridge in accordance with the present invention, viewed at right angles to the longitudinal axis of the tool.

FIG. 3 is an enlarged cross-sectional view through a tool cartridge comprising reamer insert 50, rotatably disposed within cartridge bushing 40. The assembly of reamer insert 50 and cartridge bushing 40 may be referred to as a reamer cartridge 500. Reamer insert 50 has a main body 51 with a generally domed upper surface 52, into which are formed a plurality of cutter sockets 53 for receiving cutting elements 54, which project above upper surface 52 as shown. Cutting elements 54 will preferably be made from a tungsten-carbide steel alloy, as is common for cutting elements in prior art reaming tools as well as cutting tools in other fields of industry. In the illustrated embodiment, cutting elements 54 have a domed profile, but this is by way of example only; cutting elements 54 could have different profiles to suit particular field conditions.

Persons skilled in the art will appreciate that the present invention is not limited or restricted to the use of any particular style of cutting element or any particular cutting element materials. Moreover, the present invention is not limited or restricted to the use of cutting elements disposed within cutter pockets as shown in the exemplary embodiment of FIGS. 2 and 3, as the particular means by which cutting elements are attached, anchored, bonded, or otherwise integrated with main body 51 of reamer insert 50 is entirely secondary or peripheral to the present invention.

In the embodiment shown in FIGS. 1, 2, and 3, reamer insert 50 has a central cutting element 54A coincident with rotational axis A-2, plus a plurality of outer cutting elements 54B arrayed in a circular pattern around central cutting element 54A. Preferably, the outer edges of cutting elements 54A and 54B will lie at approximately the same radial distance from longitudinal axis A-1 when reamer cartridge 500 is mounted in tool body 20, with said radial distance corresponding to the desired borehole diameter (or "gauge"). Due to the previously-mentioned offset of rotational axis A-2 relative to longitudinal axis A-1, at least one of the outer cutting elements 54B on one side of rotational axis A-2 (i.e., viewing reamer/stabilizer 10 in transverse cross-section, as in FIGS. 2 and 3) will contact the wall of a wellbore before the outer cutting elements 54B on the other side of rotational axis A-2. This unbalanced or eccentric contact between outer cutting elements 54B and the wellbore wall will induce rotation of reamer insert 50 when reamer/stabilizer 10 is moved axially and non-rotatingly within the wellbore (such as during slide drilling or tripping operations). In preferred embodiments in which two or more reamer inserts 50 are provided in each blade 35 of reamer/stabilizer 10, the effective cutting widths of the reamer inserts 50 (as defined by the layout of outer cutting elements 54B) will overlap to provide effective reaming around the full perimeter of the wellbore wall even during non-rotating axial movement of reamer/stabilizer 10.

Reamer insert 50 is mounted in cartridge bushing 40 so as to be freely rotatable within cartridge bushing 40, about rotational axis A-2. Persons skilled in the art will appreciate that this functionality can be provided in a variety of ways using known technologies, and the present invention is not limited to any particular way of mounting reamer insert 50 in or to cartridge bushing 40. In the non-limiting exemplary embodiment shown in FIG. 3, main body 51 of reamer insert 50 has a cylindrical outer side surface 51A; a generally planar lower surface 51B bounded by cylindrical outer side surface 51A; and a cylindrical hub 55 coaxial with rotational axis A-2 and projecting below lower surface 51B.

Cartridge bushing 40 is formed with a cylindrical cavity defined by a perimeter wall 41 with an inner cylindrical surface 41A having a diameter slightly larger than the diameter of cylindrical side surface 51A (so as to allow free rotation of reamer insert 50 within cartridge bushing 40, preferably with minimal tolerance); a base section 42 bounded by cylindrical side wall 41 and having an upper surface 42A; and a circular opening 44 extending through base section 42 and having a centroidal axis coincident with rotational axis A-2, with circular opening 44 being sized to receive cylindrical hub 55 of reamer insert 50. Reamer insert 50 is positioned within cartridge bushing 40 with cylindrical hub 55 disposed within circular opening 44 and projecting below base section 42. Reamer insert 50 is rotatably retained within bushing 40 by means of a snap ring 56 disposed within a corresponding groove in the perimeter surface of cylindrical hub 55, below base section 42, as shown in FIG. 3. Suitable bearings (shown for purposes of FIG. 3 as ball bearings 57) are provided in suitable bearing races in upper surface 42A of base section 42 and in lower surface 51B of main body 51 of reamer insert 50, to transfer radially-acting reaming forces from reamer insert 50 to cartridge bushing 40. Persons skilled in the art will appreciate that there are various other ways of rotatably securing reamer insert 50 within cartridge bearing 40, and the present invention is not restricted to the use of the particular components described and illustrated herein for achieving this functionality.

Reamer cartridges 500 are removably retained within corresponding cartridge pockets 37 in reamer/stabilizer 10. Persons skilled in the art will appreciate that this can be accomplished in a number of ways using known methods, and the present invention is not limited to any particular method or means of removably retaining reamer cartridges 500 within their respective cartridge pockets 37. However, in the preferred embodiment shown in FIG. 3, this is accomplished by configuring cartridge bushing 40 with two opposing and generally straight end walls 43, into each of which is formed an elongate groove 46 of generally semi-circular cross-section. Each cartridge pocket 37 has corresponding opposing end walls with corresponding semi-circular grooves 34 as shown in dotted outline in FIG. 3. When cartridge bushings 40 are positioned within corresponding cartridge pockets 37, each groove 46 of each cartridge bushing 40 will be aligned with a corresponding groove 34 in a corresponding cartridge pocket end wall, so as to define a cylindrical channel formed partly in a bushing end wall and partly in a cartridge pocket end wall, as seen in FIG. 3.

Referring to FIG. 1, a pair of spring pin bores 36 pass through each blade section 35 on secant lines on either side of each cartridge pocket 37, with each spring pin bore 36 being aligned with the cylindrical channel formed by the corresponding groove 34 in cartridge pocket 37 and groove 46 in cartridge bushing 40. Accordingly, a spring pin 39 (or other suitable type of fastening pin) can be inserted through each spring pin bore 36 to intercept the cylindrical channel in the corresponding cartridge bushing 40 and cartridge pocket end wall, as conceptually illustrated in FIG. 3. With spring pins 39 thus in place, reamer cartridges 500 are securely retained in their corresponding cartridge pockets 37.

This particular method of assembly facilitates quick and simple cartridge change-out in the shop or in the field, without need for special tools. To remove a cartridge from reamer/stabilizer 10, the corresponding spring pins 39 may be simply driven out of their spring pin bores 36 using a hammer and a suitable metal rod having a smaller diameter than the spring pin bore 36. The cartridge can then be easily pried out of its cartridge pocket 37, preferably with the aid of longitudinally-oriented pry grooves 38 formed into blade 35 at each end of each cartridge pocket 37, as shown in FIG. 1.

When it is desired to use reamer/stabilizer 10 as a stabilizer, reamer cartridges 500 may be removed from their respective cartridge pockets 37 and replaced with stabilizer cartridges 600. As illustrated by way of exemplary embodiment in FIG. 4, each stabilizer cartridge 600 comprises a cartridge bushing 40 and a stabilizer insert 60. Cartridge bushings 40 for purposes of stabilizer cartridges 600 will preferably be identical in all respects to cartridge bushings 40 for purposes of reamer cartridges 500 as illustrated in FIGS. 2 and 3; for this reason, not all elements and features of cartridge bushing 40 are indicated by reference numbers in FIG. 4.

Figure 4:
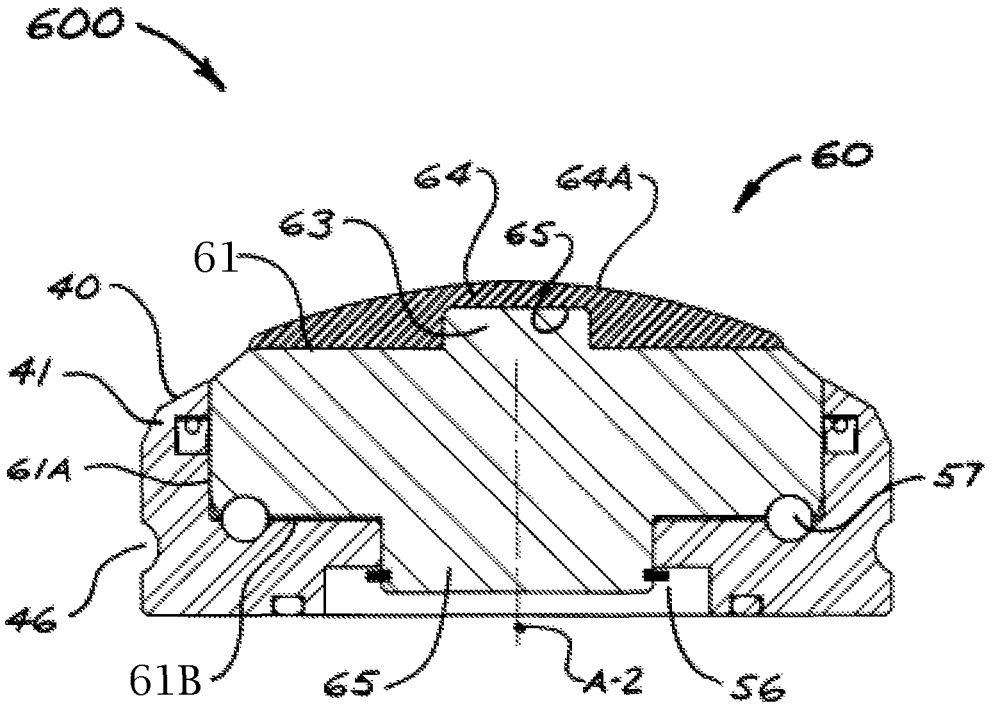
FIG. 4 is an enlarged cross-section through one embodiment of a stabilizer cartridge in accordance with the present invention, viewed at right angles to the longitudinal axis of the tool.

The configuration and features of stabilizer insert 60, in the embodiment shown in FIG. 4, is generally similar to the embodiment of reamer insert 50 shown in FIG. 3, with stabilizer insert 60 having a main body 61 similar to main body 51 of reamer insert 50, and with main body 61 having a cylindrical outer side surface 61A and a planar lower surface 61B similar to corresponding features 51A and 51B of reamer insert 50. However, instead of having cutting elements as in reamer insert 50, stabilizer insert 60 is fitted with a hard-faced stabilizer element 64 (which may be alternatively referred to as a stabilizer cone, although stabilizer element 64 will not necessarily have a conical profile). Preferably, the upper surface 64A of stabilizer element 64 will be generally spherical, with a radius of curvature preferably (but not necessarily) corresponding to the radius of the wellbore in which the tool is to be used. Stabilizer element 64 may be mounted to main body 61 of stabilizer insert 60 in any suitable fashion. In the exemplary embodiment shown in FIG. 4, main body 61 is formed with an upper projection 63 disposable within a corresponding pocket 65 formed into the lower surface of stabilizer element 64. Upper projection 63 may be secured within pocket 65 by any suitable known means, which could include an adhesive or friction fit.

In some applications, it may be beneficial to fit reamer/stabilizer 10 with a combination of reamer cartridges 500 and stabilizer cartridges 600. In addition, it is possible that other wellbore conditioning needs may require or suggest the use of tool cartridges adapted for purposes other than reaming and stabilizing, and the use of such alternative types of tool cartridges is intended to come within the scope of the present invention. In other applications, effective use of reamer/stabilizer 10 may be possible with well conditioning cartridges installed in some but not all of the cartridge pockets 37 of reamer/stabilizer 10.

In alternative embodiments of reamer/stabilizer 10, the rotational axis A-2 of the tool inserts (e.g., reamer inserts 50 and stabilizer inserts 60) may intersect longitudinal axis A-1 of tool body 20, rather than being offset as shown in FIG. 2. This configuration may result in the inserts being less readily rotatable during non-rotating axial movement of the drill string, but will not detract significantly or at all from the effectiveness of reamer/stabilizer 10 during operations in which the drill string is being rotated.

It will be readily appreciated by those skilled in the art that various modifications of the present invention may be devised without departing from the scope and teaching of the present invention, including modifications which may use equivalent structures or materials hereafter conceived or developed. It is to be especially understood that the invention is not intended to be limited to any described or illustrated embodiment, and that the substitution of a variant of a claimed element or feature, without any substantial resultant change in the working of the invention, will not constitute a departure from the scope of the invention. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure. Relational terms such as "parallel", "perpendicular", "coincident", "intersecting", and "equidistant" are not intended to denote or require absolute mathematical or geometrical precision. Accordingly, such terms are to be understood as denoting or requiring substantial precision only (e.g., "substantially parallel") unless the context clearly requires otherwise.

The Embodiments of the invention in which an exclusive property or privilege is claimed are defined as follows:

1. A downhole tool comprising an elongate main body having:

(a) a longitudinal axis;

(b) an outer surface; and (c) a plurality of channels formed into said outer surface, said channels dividing the main body into a plurality of blade sections corresponding in number to the number of channels;

wherein each of at least two of the blade sections has one or more cartridge pockets formed into the outer surface thereof, each cartridge pocket being configured to receive a tool cartridge housing a tool insert such that the tool insert is confined to rotate by a side wall about a rotational axis transverse to, and offset from, the longitudinal axis of the main body, wherein the downhole tool forms a slide reamer and at least one of the tool inserts is a reamer insert having a plurality of cutting elements; and wherein the tool cartridge has a cylindrical inner surface for housing the tool insert and wherein the tool insert has a cylindrical side surface portion complementary to the cylindrical inner surface, the cylindrical side surface portion having a centroidal axis, such that the tool insert is confined to rotate, by the cylindrical inner surface, about a rotational axis transverse to, and offset from, the longitudinal axis of the main body, the rotational axis being coincident with the centroidal axis of the cylindrical side surface portion of the tool insert.

2. The downhole tool of claim 1 wherein the channels are angularly skewed relative to the longitudinal axis of the main body.

3. The downhole tool of claim 1 wherein the reamer insert has a generally domed upper surface, with the cutting elements being disposed within corresponding sockets formed into said domed upper surface.

4. The downhole tool of claim 1 wherein the plurality of cutting elements includes a central cutting element on the rotational axis of the reamer insert, plus outer cutting elements arrayed in a circular pattern around the central cutting element.

5. The downhole tool of claim 1 wherein at least one of the tool inserts is a stabilizer insert having a hard-faced stabilizer element.

6. The downhole tool of claim 5 wherein the stabilizer element has a domed upper surface.

7. The downhole tool of claim 1 wherein at least one tool cartridge is removably retained within its corresponding cartridge pocket by way of a pair of elongated spring pins axially spaced on opposite sides of the cartridge pocket, with each spring pin engaging a cylindrical channel formed by a semi-circular groove in the cartridge bushing of the tool cartridge and an adjacent, parallel semi-circular groove in an end wall of the cartridge pocket.

8. The downhole tool of claim 1 in which the outer surface of the main body has a uniform cross-section over a central section that includes the blade sections.

9. A downhole tool comprising an elongate main body having:

(a) a longitudinal axis;

(b) an outer surface;

(c) three channels formed into said outer surface, said channels dividing a central portion of the main body into three blade sections; and (d) one or more cartridge pockets formed into each blade section; wherein:

(e) at least one cartridge pocket in each blade section has a tool cartridge removably retained therein, said tool cartridge comprising:

(e.1) a cartridge bushing having a cylindrical bore with a centroidal axis transverse to, and offset from, the longitudinal axis of the main body; and (e.2) a tool insert rotatable within the cartridge bushing about a rotational axis coincident with said centroidal axis of the cartridge bushing, and wherein the downhole tool forms a slide reamer and at least one of the tool inserts is a reamer insert having a plurality of cutting elements;

wherein the cartridge bushing has a cylindrical inner surface and wherein the tool insert has a cylindrical side surface portion complementary to the cylindrical inner surface, such that the tool insert is confined to rotate, by the cylindrical inner surface, within the cartridge bushing about a rotational axis coincident with said centroidal axis of the cartridge bushing.

10. The downhole tool of claim 9 wherein the channels are angularly skewed relative to the longitudinal axis of the main body.

11. The downhole tool of claim 9 wherein the reamer insert has a generally domed upper surface, with the cutting elements being disposed within corresponding sockets formed into said domed upper surface.

12. The downhole tool of claim 9 wherein the plurality of cutting elements includes a central cutting element on the rotational axis of the reamer insert, plus outer cutting elements arrayed in a circular pattern around the central cutting element.

13. The downhole tool of claim 9 wherein at least one of the tool inserts is a stabilizer insert having a hard-faced stabilizer element.

14. The downhole tool of claim 13 wherein the stabilizer element has a domed upper surface.

15. The downhole tool of claim 9 wherein at least one tool cartridge is removably retained within its corresponding cartridge pocket by way of a pair of elongated spring pins axially spaced on opposite sides of the cartridge pocket, with each spring pin engaging a cylindrical channel formed by a semi-circular groove in the cartridge bushing of the tool cartridge and an adjacent, parallel semi-circular groove in an end wall of the cartridge pocket.

16. The downhole tool of claim 9 in which the outer surface of the main body has a uniform cross-section over a central section that includes the blade sections.

17. A tool cartridge radially mountable in a cartridge pocket formed in a downhole tool, said tool forming a slide reamer, cartridge comprising:

(a) a cartridge bushing having a cylindrical cavity defined by:

(a.1) a cylindrical side wall with an inner cylindrical surface;

(a.2) a base section bounded by said cylindrical side wall and having an upper surface; and (a.3) a circular opening extending through said base section; and (b) a tool insert having a main insert body, said main insert body having:

(b.1) a cylindrical outer side surface and a centroidal axis, the diameter of said cylindrical outer side surface being slightly smaller than the diameter of the cylindrical cavity of the cartridge bushing;

(b.2) an upper surface having a plurality of cutter sockets, each cutter socket having disposed therein a cutting element projecting above said upper surface; and (b.3) a cylindrical lower hub having a diameter slightly smaller than the diameter of the circular opening in the base section of the cartridge bushing;

wherein said tool insert is disposed within said cylindrical cavity of the cartridge bushing, with said cylindrical lower hub extending through said circular opening in the base section of the cartridge bushing, such that the tool insert is rotatable relative to the cartridge bushing about a rotational axis coincident with said centroidal axis of the main insert body, wherein the circular opening comprises a second inner cylindrical surface extending through said base section, wherein the diameter of said outer side surface is slightly smaller than the diameter of the first inner cylindrical surface of the cartridge bushing, wherein said cylindrical lower hub has a diameter slightly smaller than the diameter of the second inner cylindrical surface in the base section of the cartridge bushing, and wherein said cylindrical lower hub is disposed within said second inner cylindrical surface in the base section of the cartridge bushing, such that the tool insert is confined to rotate, by the second inner cylindrical surface of the cartridge bushing, relative to the cartridge bushing about a rotational axis coincident with said centroidal axis of the main insert body, and wherein at least one of the tool inserts is a reamer insert having a plurality of cutting elements.

18. The tool cartridge of claim 17 wherein the reamer insert has a generally domed upper surface, with the cutting elements being disposed within corresponding sockets formed into said domed upper surface.

19. The tool cartridge of claim 17 wherein the plurality of cutting elements includes a central cutting element on the rotational axis of the reamer insert, plus outer cutting elements arrayed in a circular pattern around the central cutting element.

* * * * *